US011105545B2

(12) United States Patent
Ma et al.

(10) Patent No.: US 11,105,545 B2
(45) Date of Patent: Aug. 31, 2021

(54) PURGE SYSTEM FOR CHILLER SYSTEM

(71) Applicant: Carrier Corporation, Palm Beach Gardens, FL (US)

(72) Inventors: Zidu Ma, Ellington, CT (US); Ivan Rydkin, Rochester, NY (US); Warren Clough, Cicero, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 337 days.

(21) Appl. No.: 16/095,069

(22) PCT Filed: Apr. 19, 2017

(86) PCT No.: PCT/US2017/028235
§ 371 (c)(1),
(2) Date: Oct. 19, 2018

(87) PCT Pub. No.: WO2017/184663
PCT Pub. Date: Oct. 26, 2017

(65) Prior Publication Data

US 2019/0113262 A1 Apr. 18, 2019

Related U.S. Application Data

(60) Provisional application No. 62/324,667, filed on Apr. 19, 2016.

(51) Int. Cl.
*F25B 43/04* (2006.01)
*F25B 45/00* (2006.01)

(52) U.S. Cl.
CPC ..... *F25B 43/043* (2013.01); *F25B 45/00* (2013.01); *F25B 2345/002* (2013.01); *F25B 2345/003* (2013.01)

(58) Field of Classification Search
CPC .. F25B 43/043; F25B 45/00; F25B 2345/003; F25B 41/04
(Continued)

(56) References Cited

U.S. PATENT DOCUMENTS 4,842,621 A 6/1989 Robbins et al.
4,984,431 A 1/1991 Mount et al.
(Continued)

FOREIGN PATENT DOCUMENTS

CN 104815519 A 8/2015

OTHER PUBLICATIONS

Chinese Office Action for Chinese Application No. 201780024869.1; dated May 25, 2020, 8 pages.
(Continued)

*Primary Examiner* — Ana M Vazquez
(74) *Attorney, Agent, or Firm* — Cantor Colburn LLP

(57) ABSTRACT

A purge system for removing non-condensables from a chiller system includes a purge chamber, a plurality of carbon beds fluidly connected to the purge chamber into which a flow of refrigerant and non-condensables is selectably directed from the purge chamber to remove the non-condensables therefrom. A vent line is fluidly connected to the plurality of carbon beds to dispose of the collected non-condensables, and a heater is operably connected to the plurality of carbon beds to selectably heat one or more of the carbon beds of the plurality of carbon beds to release refrigerant therefrom and direct the released refrigerant to the purge chamber.

17 Claims, 3 Drawing Sheets

(58) Field of Classification Search
USPC ..... 62/85, 195
See application file for complete search history.

(56) References Cited

U.S. PATENT DOCUMENTS

| | | | |
|---|---|---|---|
| 5,044,166 | A | 9/1991 | Wijmans et al. |
| 5,187,953 | A | 2/1993 | Mount |
| 5,209,074 | A | 5/1993 | McConnell et al. |
| 5,303,564 | A | 4/1994 | Britt |
| 5,313,805 | A | 5/1994 | Blackmon et al. |
| 5,515,690 | A | 5/1996 | Blackmon et al. |
| 5,598,714 | A | 2/1997 | Strout et al. |
| 5,910,160 | A | 6/1999 | Cakmakci et al. |
| 5,943,867 | A | 8/1999 | Thomas et al. |
| 6,128,916 | A | 10/2000 | Callahan et al. |
| 6,260,378 | B1 | 7/2001 | Sagar |
| 6,705,100 | B2 | 3/2004 | Heiden et al. |
| 7,357,002 | B2 | 4/2008 | Yoshimi et al. |
| 2013/0283832 | A1 | 10/2013 | Kujak et al. |

OTHER PUBLICATIONS

International Search Report for International Application No. PCT/US2017/028235; International Filing Date Apr. 19, 2017; dated Jul. 17, 2017; 5 Pages.

Written Opinion for International Application No. PCT/US2017/028235; International Filing Date Apr. 19, 2017; dated Jul. 17, 2017; 5 Pages.

PURGE SYSTEM FOR CHILLER SYSTEM

CROSS REFERENCE TO RELATED APPLICATIONS

This application is a National Stage application of PCT/US2017/028235, filed Apr. 19, 2017, which claims the benefit of U.S. Provisional Application No. 62/324,667, filed Apr. 19, 2016, both of which are incorporated by reference in their entirety herein.

BACKGROUND

Embodiments relate generally to chiller systems used in air conditioning systems, and more particularly to a purge system for removing non-condensables from a chiller system.

Low pressure chiller systems may include sections that operate below atmospheric pressure. As a result, leaks in the chiller system may draw non-condensables, such as air into the system, contaminating the refrigerant. This non-condensable degrades the performance of the chiller system. To address this problem, existing low pressure chillers include a purge unit to remove non-condensables. For typical purge systems, there are usually two steps in the process, a condensing step and a residual collection step. The condensing step can be an air cooled condenser or a condenser cooled by another vapor compression cycle, i.e. another independent refrigeration system. The residual collection step usually involves an adsorption medium (such as activated carbon) to collect the refrigerant residual to cut down the amount of refrigerant released to the atmosphere. The adsorption medium can be either regenerated onboard the purge system or be regenerated offline. Onboard regeneration has a better recovery of refrigerant than offline regeneration, but state of the art purge systems with onboard regeneration of the adsorption medium cannot achieve a refrigerant release to ambient lower than that with offline regeneration.

SUMMARY

In one embodiment, a purge system for removing non-condensables from a chiller system includes a purge chamber, a plurality of carbon beds fluidly connected to the purge chamber into which a flow of refrigerant and non-condensables is selectably directed from the purge chamber to remove the non-condensables therefrom. A vent line is fluidly connected to the plurality of carbon beds to dispose of the collected non-condensables, and a heater is operably connected to the plurality of carbon beds to selectably heat one or more of the carbon beds of the plurality of carbon beds to release refrigerant therefrom and direct the released refrigerant to the purge chamber.

Additionally or alternatively, in this or other embodiments the plurality of carbon beds are arranged in a fluidly parallel arrangement.

Additionally or alternatively, in this or other embodiments a heater is operably connected to a carbon bed of the plurality of carbon beds.

Additionally or alternatively, in this or other embodiments the plurality of carbon beds are arranged in a fluidly serial arrangement.

Additionally or alternatively, in this or other embodiments a sensor is configured to detect presence of refrigerant in the vent line.

Additionally or alternatively, in this or other embodiments the sensor is positioned along a fluid path between a first carbon bed of the plurality of carbon beds and a second carbon bed of the plurality of carbon beds.

Additionally or alternatively, in this or other embodiments when the sensor detects the presence of refrigerant, flow is moved from the first carbon bed through the second carbon bed and to the purge chamber.

Additionally or alternatively, in this or other embodiments a pumping element urges flow from the purge chamber to the plurality of carbon beds.

Additionally or alternatively, in this or other embodiments the pumping element is one of a compressor or a vacuum pump.

Additionally or alternatively, in this or other embodiments a purge chamber outlet selectably directs refrigerant from the purge chamber to the chiller system.

In another embodiment, a method of removing non-condensables from refrigerant in a chiller system includes moving a flow of refrigerant and associated non-condensables from a purge chamber to a plurality of carbon beds, directing the flow through at least one carbon bed of the plurality of carbon beds thereby capturing refrigerant at the plurality of carbon beds, directing a decontaminated flow of refrigerant, with non-condensables removed, to the purge chamber, and venting the non-condensables to ambient.

Additionally or alternatively, in this or other embodiments the vented non-condensables are sensed for the presence of refrigerant in the vented non-condensables, and the release of the non-condensables to ambient is halted if refrigerant is detected by the sensor Additionally or alternatively, in this or other embodiments the plurality of carbon beds are selectably heated to regenerate the plurality of carbon beds, releasing refrigerant captured by the plurality of carbon beds.

Additionally or alternatively, in this or other embodiments the released refrigerant is directed from the plurality of carbon beds to the purge chamber.

Additionally or alternatively, in this or other embodiments refrigerant and non-condensables are flowed through a first carbon bed of the plurality of carbon beds, and flowing the refrigerant and non-condensables into a second carbon bed of the plurality of carbon beds.

Additionally or alternatively, in this or other embodiments the flow is urged from and to the purge chamber via a pumping element.

Additionally or alternatively, in this or other embodiments the decontaminated flow of refrigerant is urged from the purge chamber to the chiller system.

These and other advantages and features will become more apparent from the following description taken in conjunction with the drawings.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

The detailed description explains embodiments, together with advantages and features, by way of example with reference to the drawings.

DETAILED DESCRIPTION

Figure 1:
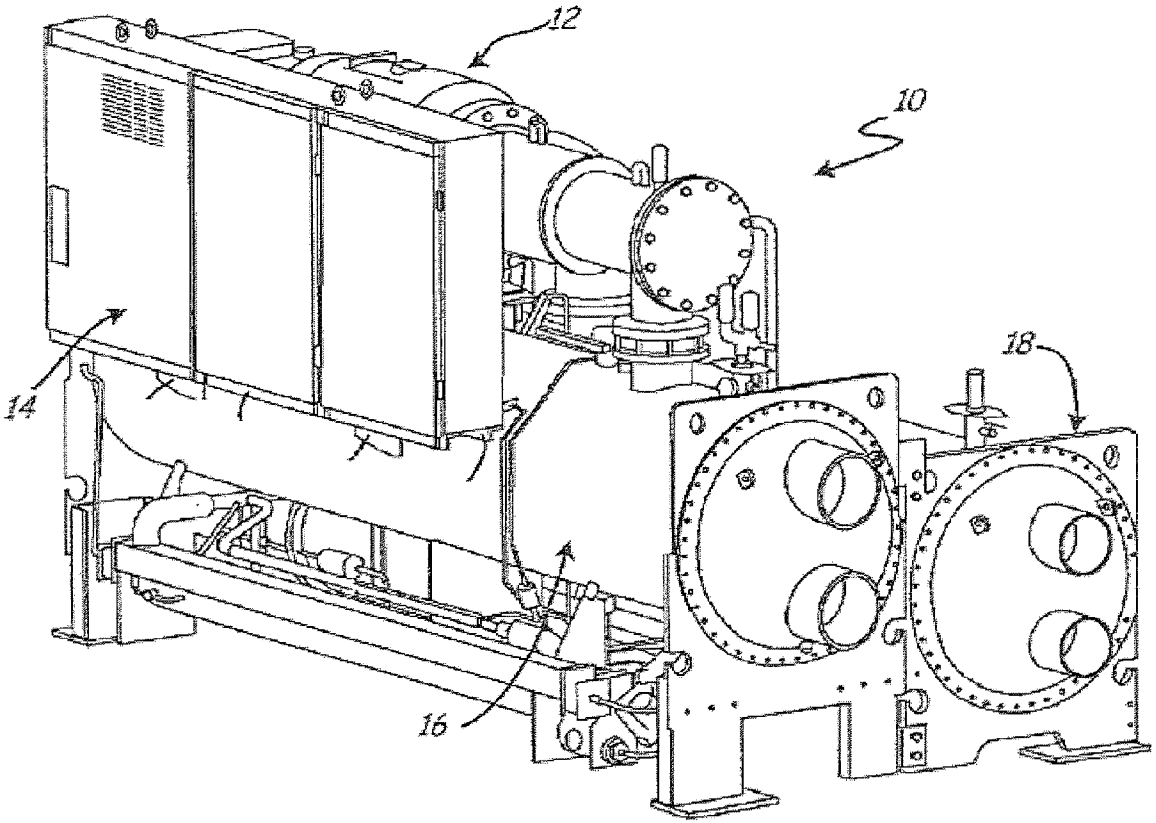
FIG. 1 is a schematic view of an embodiment of a chiller system.

FIG. 1 depicts a chiller system 10 in an exemplary embodiment. Chiller system 10 is a screw chiller, but embodiments of the invention are appropriate for use with other compression chiller assemblies, such as, for example, a centrifugal chiller. As shown in FIG. 1, chiller system 10 includes compressor 12, variable frequency drive 14, condenser 16 and cooler 18.

In operation, gaseous refrigerant is induced into compressor 12 and compressed. Compressor 12 is driven by a motor under the control of variable frequency drive 14. Variable frequency drive 14 controls the frequency of the alternating current (AC) supplied to the motor thereby controlling the speed of the motor and the output of compressor 12. After the refrigerant is compressed, the high temperature, high pressure refrigerant gas is supplied to condenser 16. In condenser 16, the gaseous refrigerant condenses into liquid as it gives up heat. The condensed liquid refrigerant then flows into cooler 18, which circulates chilled water. The low pressure environment in cooler 18 causes the refrigerant to change states to a gas and, as it does so, it absorbs the required heat of vaporization from the chilled water, thus reducing the temperature of the water. The low pressure vapor is then drawn into the inlet of compressor 12 and the cycle is continually repeated. The chilled water is circulated through a distribution system to cooling coils for, for example, comfort air conditioning.

Portions of the chiller system 10 (e.g., cooler 18) may operate at a low pressure (e.g., less than atmosphere) which can cause non-condensables (e.g., ambient air) to be drawn into the chiller system 10. The non-condensables in the refrigerant flow of the chiller system 10 degrades performance of the chiller.

Figure 2:
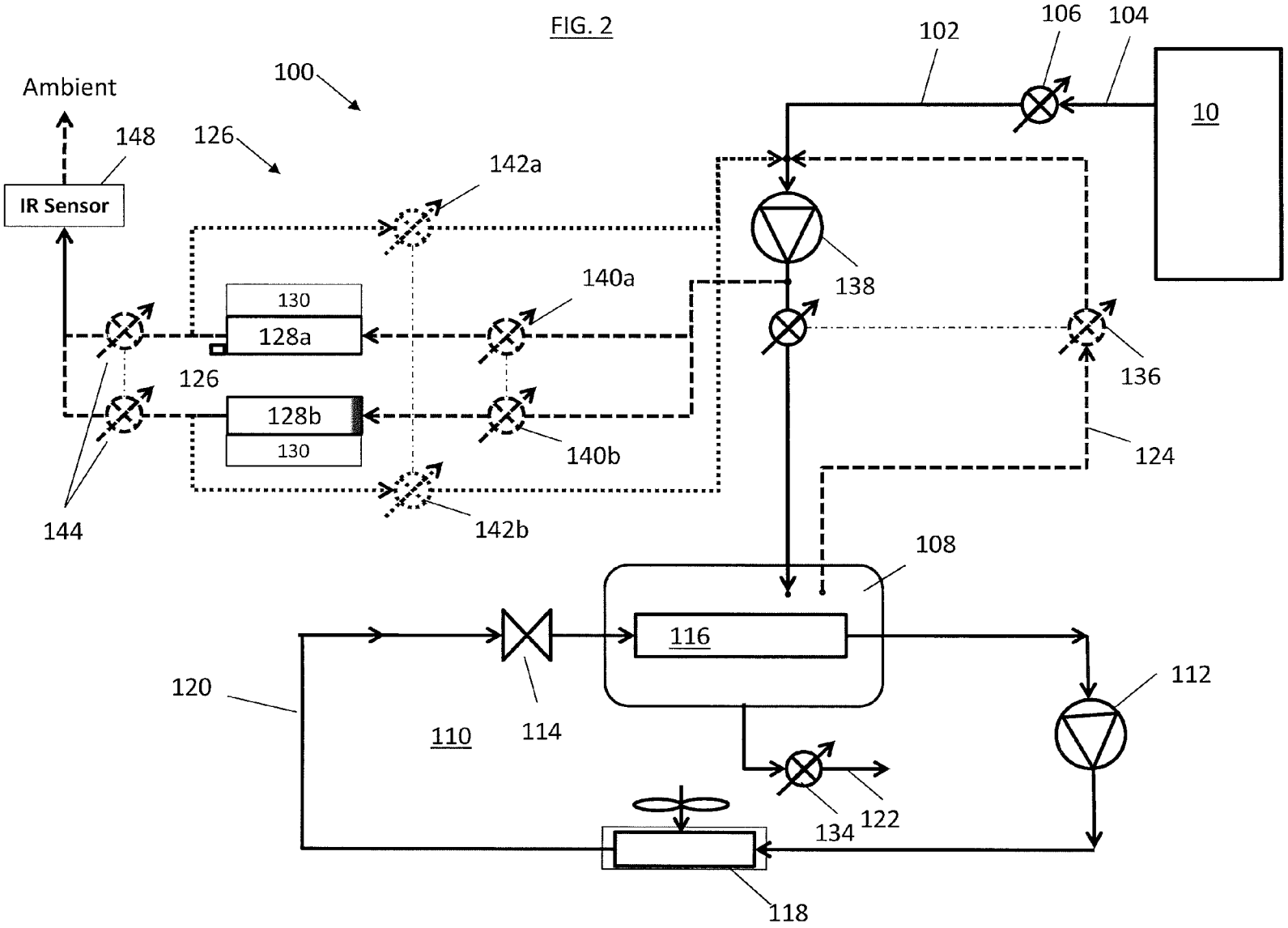
FIG. 2 is a schematic view of an embodiment of a purge system for a chiller system.

FIG. 2 depicts a purge system 100 fluidly connected to the chiller system 10, for removing non-condensables from the chiller system 10. Purge system 100 includes a purge input line 102 through which chiller refrigerant 104, containing non-condensables, flows from the chiller system 10 into the purge system 100. Flow of the chiller refrigerant 104 along the purge input line 102 is controlled by purge input valve 106. The purge input line 102 directs the chiller refrigerant 104 into a purge tank 108, which is one element of a purge vapor compression cycle 110, including a purge compressor 112, a purge expansion valve 114, a purge evaporator 116 that resides in the purge tank 108, and a purge condenser 118, which may be air cooled or water cooled. The purge vapor compression cycle utilizes a purge refrigerant flow 120, which may be the same refrigerant material as the chiller refrigerant 104, or alternatively may be a different refrigerant material. At the purge evaporator 116, the purge refrigerant flow 120 exchanges thermal energy with the chiller refrigerant 104, condenses at least a portion of the chiller refrigerant 104 to a liquid, with a lesser degree of non-condensables, which is directed back to chiller system 10 through purge output line 122.

Figure 3:
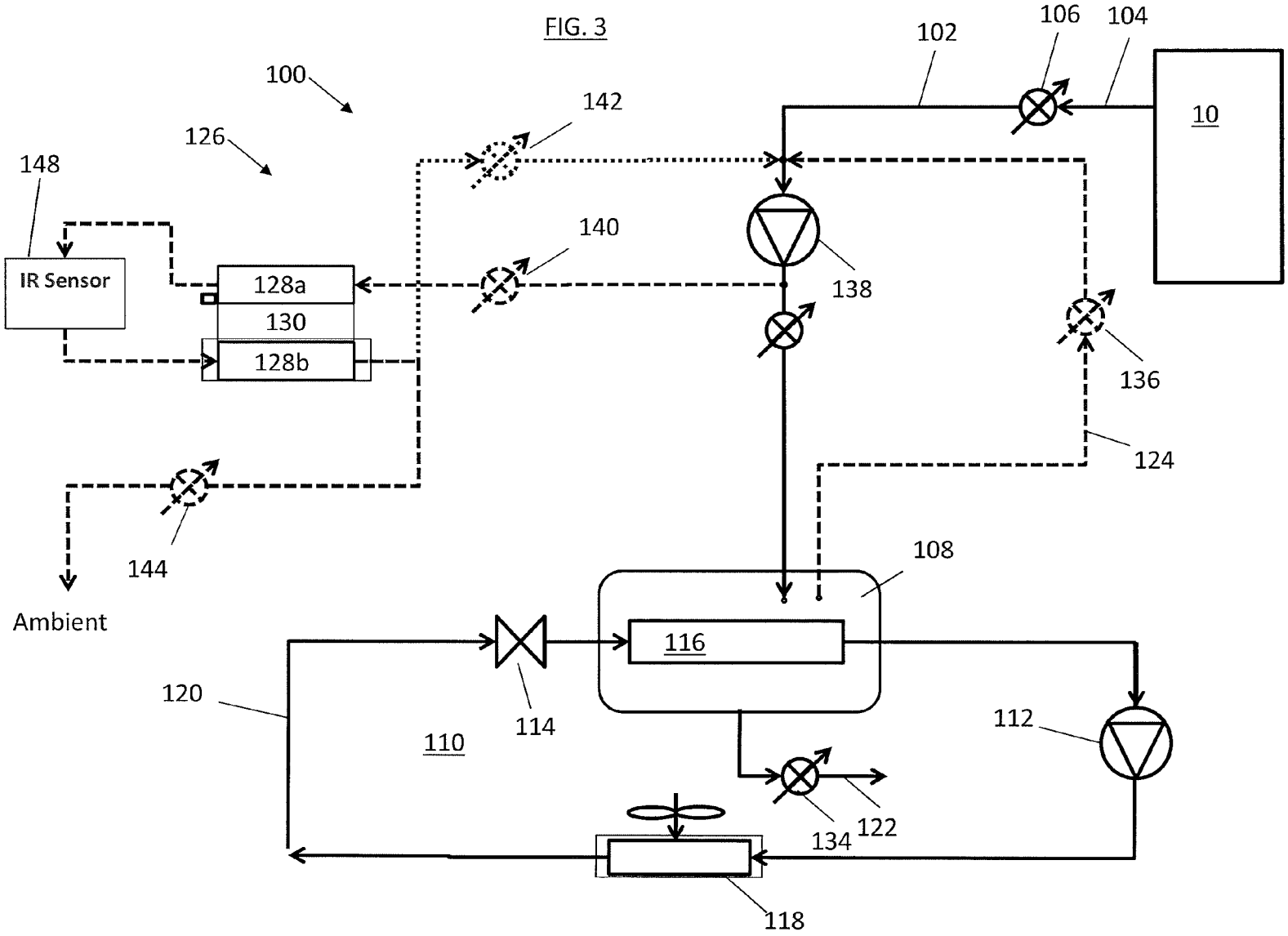
FIG. 3 is a schematic of another embodiment of a purge system for a chiller system.

The remaining chiller refrigerant 104 with non-condensables is collected at the purge tank 108, which becomes pressurized by the increasing amount of chiller refrigerant 104 and non-condensables present in the purge tank 108. An evacuation line 124 connects the purge tank 108 to a regeneration system 126 arranged to remove the non-condensables from the chiller refrigerant 104 and recover chiller refrigerant 104 to be returned to the chiller system 10. The regeneration system 126 includes two or more carbon beds 128 fluidly connected to the evacuation line 124. In some embodiments, the carbon beds 128 are arranged in a fluidly parallel arrangement as shown in FIG. 2, or alternatively as shown in FIG. 3, the carbon beds 128 may be arranged in a fluidly serial arrangement.

Referring again to FIG. 2, each carbon bed 128 is in thermal communication with a heater 130 utilized to periodically regenerate the associated carbon bed 128 by heating the carbon bed 128 and direct the non-condensables collected at the carbon bed 128 to ambient 132. Multiple carbon beds 128 allow longer continuous operation of the regeneration system 126 and connected purge system 100 as will be explained in more detail below.

Referring to FIG. 2, when purge tank 108 reaches a selected pressure indicating buildup of chiller refrigerant 104 and non-condensables in the purge tank 108, purge input valve 106 and a purge outlet valve 134 are closed to isolate the purge system 106 and the regeneration system 126 from the chiller system 10. Evacuation valve 136 is opened and chiller refrigerant 104 and non-condensables move from the purge tank 108 to the regeneration system 126, either by pressure in the purge tank 108 or by regeneration compressor 138 or vacuum pump. Carbon bed input valves **140*a* and 140*b* are selectably opened to direct the chiller refrigerant 104 and non-condensables to a first carbon bed 128*a* or alternatively to a second carbon bed 128*b*. Similarly, carbon bed output valves 142*a* and 142*b* are opened. The chiller refrigerant 104 and non-condensables are flowed across the first carbon bed 128*a* or the second carbon bed 128*b*, where the carbon material present in the carbon bed 128 absorbs the refrigerant. The non-condensables are released to ambient via a vent valve 144, after flowing past an IR sensor 148**.

When the refrigerant has fully adsorbed onto the carbon bed 128, the refrigerant will then begin to pass through the carbon bed 128 and flow by an IR sensor 148 to ambient via a vent valve 144 along with the non-condensables. The IR sensor 148 is utilized to sense for the presence of refrigerant in the vent flow. In the embodiment of FIG. 2, if refrigerant is detected in the vent flow by the IR sensor 148, the vent valve 144 is closed, stopping the flow from the carbon bed 128. The carbon bed 128 is then regenerated utilizing heater 130 to release any refrigerant captured in the carbon bed 128. The refrigerant 104 released from the carbon bed 128 is flowed through the carbon bed output valve 142 to the purge tank 108, where it is returned to the chiller system 10 via the purge output line 122. Through the parallel arrangement of carbon beds **128*a* and 128*b* and the valving of the purge system 100, while, for example, first carbon bed 128*a* is being regenerated, the second carbon bed 128*b* may utilized normally for purge system 100** operations.

Illustrated in FIG. 3 is another embodiment of the purge system 100, in which charcoal beds **128*a* and 128*b* are arranged in series, with the IR sensor 148 located between carbon bed 128*a* and 128*b*. The embodiment of FIG. 3 operates much like the embodiment of FIG. 2, except that during regeneration operation vent flow from the first carbon bed 128*a*, if refrigerant is detected by the IR sensor 148, is directed across the second carbon bed 128*b*, thus removing any refrigerant therefrom, prior to returning to the purge tank 108. This improves the efficiency of the purge system 100 operation by reducing an amount of non-condensables in the refrigerant 104 regenerated from the carbon bed 128*a*. In the embodiment of FIG. 3, a single heater 130 is utilized, located between carbon beds 128***a* and 128*b*, so either or both of the carbon beds 128 may be heated utilizing heater 130.

The purge system 100 with dual carbon beds 128 and IR sensor 148 results in a high rate of refrigerant recovery via operation of the purge system 100, while utilizing the IR sensor 148 to reduce refrigerant emissions to ambient. While the embodiments shown and described herein utilize two carbon beds 128, one skilled in the art will readily appreciate that in other embodiments three or more carbon beds 128 may be utilized to further increase operational efficiency of the purge system 100.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A purge system for removing non-condensables from a chiller system, the purge system comprising:

a purge chamber;

a plurality of carbon beds fluidly connected to the purge chamber into which a flow of refrigerant and non-condensables is selectably directed from the purge chamber to remove the non-condensables therefrom;

a vent line fluidly connected to the plurality of carbon beds to dispose of the collected non-condensables; and a heater operably connected to the plurality of carbon beds to selectably heat one or more of the carbon beds of the plurality of carbon beds to release refrigerant therefrom and direct the released refrigerant to the purge chamber;

wherein the heater is activated in response to detection of the presence of refrigerant in the vent line.

2. The purge system of claim 1 wherein the plurality of carbon beds are arranged in a fluidly parallel arrangement.

3. The purge system of claim 1, further comprising a plurality of heaters, each heater operably connected to a carbon bed of the plurality of carbon beds.

4. The purge system of claim 1, wherein the plurality of carbon beds are arranged in a fluidly serial arrangement.

5. The purge system of claim 1, further comprising a sensor to detect presence of refrigerant in the vent line.

6. The purge system of claim 5, wherein the sensor is positioned along a fluid path between a first carbon bed of the plurality of carbon beds and a second carbon bed of the plurality of carbon beds.

7. The purge system of claim 6, wherein when the sensor detects the presence of refrigerant, flow is moved from the first carbon bed through the second carbon bed and to the purge chamber.

8. The purge system of claim 1, further comprising a pumping element to urge flow from the purge chamber to the plurality of carbon beds.

9. The purge system of claim 8, wherein the pumping element is one of a compressor or a vacuum pump.

10. The purge system of claim 1, further comprising a purge chamber outlet to selectably direct refrigerant from the purge chamber to the chiller system.

11. A method of removing non-condensables from refrigerant in a chiller system, the method comprising:

moving a flow of refrigerant and associated non-condensables from a purge chamber to a plurality of carbon beds;

directing the flow through at least one carbon bed of the plurality of carbon beds thereby capturing refrigerant at the plurality of carbon beds;

directing a decontaminated flow of refrigerant, with non-condensables removed, to the purge chamber;

venting the non-condensables to ambient;

sensing the vented non-condensables for the presence of refrigerant in the vented non-condensables; and operating a heater disposed at the plurality of carbon beds in response to the sensing of the presence of refrigerant in the vented non-condensables to regenerate a carbon bed of the plurality of carbon beds.

12. The method of claim 11, further comprising:

halting the release of the non-condensables to ambient if refrigerant is detected by the sensor.

13. The method of claim 11, further comprising selectably heating the plurality of carbon beds to regenerate the plurality of carbon beds, releasing refrigerant captured by the plurality of carbon beds.

14. The method of claim 13, further comprising directing the released refrigerant from the plurality of carbon beds to the purge chamber.

15. The method of claim 11, further comprising;

flowing refrigerant and non-condensables through a first carbon bed of the plurality of carbon beds; and flowing the refrigerant and non-condensables into a second carbon bed of the plurality of carbon beds.

16. The method of claim 11, further comprising urging the flow from and to the purge chamber via a pumping element.

17. The method of claim 11, further comprising urging the decontaminated flow of refrigerant from the purge chamber to the chiller system.

* * * * *